US006840797B2

(12) United States Patent
Ueda et al.

(10) Patent No.: US 6,840,797 B2
(45) Date of Patent: Jan. 11, 2005

(54) STRUCTURE FOR ENGAGING AND RELEASING CONNECTORS

(75) Inventors: Hirohisa Ueda, Shizuoka (JP); Kaoru Matsumura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 15 days.

(21) Appl. No.: 10/603,785

(22) Filed: Jun. 26, 2003

(65) Prior Publication Data

US 2004/0002255 A1 Jan. 1, 2004

(30) Foreign Application Priority Data

Jun. 26, 2002 (JP) ..... 2002-185796

(51) Int. Cl.[7] ..... H01R 12/24
(52) U.S. Cl. ..... 439/495
(58) Field of Search ..... 439/495, 260

(56) References Cited

U.S. PATENT DOCUMENTS 5,308,262 A * 5/1994 Chishima ..... 439/495
5,727,968 A * 3/1998 Ito ..... 439/495
5,934,932 A * 8/1999 Ito ..... 439/495
6,004,156 A * 12/1999 Roque et al. ..... 439/495
6,250,966 B1 * 6/2001 Hashimoto et al. ..... 439/631
6,561,843 B1 * 5/2003 Ma et al. ..... 439/495
6,739,902 B2 * 5/2004 Miyazawa et al. ..... 439/495

FOREIGN PATENT DOCUMENTS

| | | |
|---|---|---|
| JP | 1-111478 | 7/1989 |
| JP | 4-322087 | 11/1992 |
| JP | 9-63718 | 3/1997 |
| JP | 2000-164295 | 6/2000 |

* cited by examiner

*Primary Examiner*—Gary Paumen
(74) *Attorney, Agent, or Firm*—Armstron, Kratz, Quintos, Hanson & Brooks, LLP

(57) ABSTRACT

A leg portion is provided at a second connector so that a gap is created between a flat circuit body and a circuit board. The leg portion also serves as a positioning projection, and a locking hole for being engaged with the positioning projection is provided at the flat circuit body. A guiding groove for receiving the leg portion is formed at a first connector. A guiding part for receiving the first connector in a sliding manner is formed at an end of an opening of the first connector, and an inclined part for sliding the guiding part there along is formed at an end of an engaging part of the second connector.

13 Claims, 9 Drawing Sheets

STRUCTURE FOR ENGAGING AND RELEASING CONNECTORS

BACKGROUND OF THE INVENTION

1. Field of the Invention

This invention relates to a structure for engaging and releasing connectors for transmitting a control signal of an electric equipment.

2. Description of the Related Art

Some examples of a connector having a flat circuit body are disclosed in Japanese Utility Model Application Laid-Open No. Hei 1-111478 and Japanese Patent Application Laid-Open No. Hei 9-63718. An example of a connector having a locking lever for maintaining a state of engagement of the connector is disclosed in Japanese Patent Application Laid-Open No. 2000-164295.

As shown in FIG. 10, according to the invention disclosed in Japanese Utility Model Application Laid-Open No. Hei 1-111478, a flat circuit body 151 can be reliably inserted into a direct mounted connector 155 mounted directly on a circuit board 156.

The flat circuit body 151 has a plurality of wiring conductor 151*a* arranged on a flexible insulating sheet 151*b* made of a synthetic resin. The flat circuit object 151 is attached to a reinforcing plate 152 as a hard and rigid plate-like member by such as an adhesive. The direct mounted connector 155 is for connecting electrically the flat circuit body 151 with an electronic circuit (not shown) formed on the circuit board 156.

When inserting the flat circuit body 151 in the direct mounted connector 155, by pinching a locking part 152*a* of the reinforcing plate 152 mounted at an end of the flat circuit body 151 with such as radio pliers (not shown), the end of the flat circuit body 151 is inserted into an opening (not shown) of the direct mounted connector 155. In this manner, The flat circuit body 151 can be inserted into the direct mounted connector 155 without receiving any damage.

As shown in FIG. 11, according to the invention disclosed in the Japanese Patent Application Laid-Open No. Hei 9-63718, a flat circuit body 131 is prevented from coming out by being temporarily held when inserted into a direct mounted connector 135 mounted directly on a circuit board 146. The flat circuit body 131 is attached to a reinforcing plate 132 by such as an adhesive.

The direct mounted connector 135 is composed of a housing 136 made of synthetic resin, a terminal 140 fitted in the housing 136, and a slider 145 for pushing the flat circuit body 131. A plurality of chambers 139 for accommodating terminals 140 are formed in the housing 136. A temporary maintaining part 138 is formed protruding to the chambers 139 at each side in a longitudinal direction of a top plate of the housing 136.

The terminal 140 is formed by bending a conductive substrate, and has a beam 141 at an attaching side and a beam 142 at a contacting side. A contacting point 143 for contacting the wiring conductor (not shown) of the flat circuit body 131 is formed at the beam 142 at the contacting side.

According to above, the flat circuit body 131 is pinched between the temporary maintaining part 138 and the terminal 140 to be prevented from accidentally coming out of the housing 136. Then, by pushing the slider 145 into the housing 136, the flat circuit body 131 is attached to the housing 136.

As shown in FIG. 12, Japanese Patent Application Laid-Open No. 2000-164295 discloses a locking structure for maintaining a state of engagement of a pair of connectors 100, 120 being engaged with each other and a releasing structure for releasing the engaging.

A female connector 120 is in a substantially rectangular shape, having a female connector housing 121 with chambers 122 for accommodating terminals and male terminals (not shown) accommodated in the chambers 122. A hood part 123, into which a male connector 100 is inserted, is provided at a front 122 in an engaging direction of the chambers. A locking hole 124 for engaging with a locking projection 107 of the male connector 100 is mounted on an upper surface of the hood part 123.

The male connector 100 also is in a substantially rectangular shape like the female connector 120, having a male connector housing 101 with chambers 108 for accommodating terminals and female terminals (not shown) accommodated in chambers 108. The male connector housing 101 is formed substantially equivalent to, or slightly smaller than an inner space of the hood part 123 of the female connector 120.

A cantilever-shaped locking lever 103 is formed protruding from a center of the upper surface of the male connector 100, said the locking lever 103 being extended from forward to backward of an engaging direction. A base 104 of the locking lever 103 is continuous with an upper surface of the male connector 100. A free end 105 of the locking lever 103 is continuous with the base 104 and extended substantially parallel to the upper surface of the male connector 100. Therefore, the locking lever 103 is allowed to be resiliently deformed in a vertical direction.

The locking projection 107 is formed protruding upward from a center of the locking lever 103. The locking projection 107 has a inclined part 107*a* disposed forward and a locking surface 107*b* disposed backward, the locking surface 107*b* being continued to the inclined part 107*a*.

A releasing part 110 is formed at a back end of the locking lever 103. The releasing part 110 is connected to a connecting part 111 extended upward from both right and left sides of the locking lever 103. By depressing the releasing part 110, the locking lever 103 is deformed to release the engagement between the locking hole 124 and the locking projection 107.

Moreover, a vertical wall 115 standing in a U-shape from a periphery of the releasing part 110 is provided vertically at an end of an upper surface of the male connector housing 101. An upper surface of the vertical wall 115 is formed higher than an upper surface of the releasing part 110 in a natural state where the locking lever 103 is not deformed. In this manner, the locking lever 103 is protected against an external force from outside the male connector 100 so as not to be accidentally deformed.

However, there are problems with these conventional connectors as described below.

First, according to the invention disclosed in Japanese Utility Model Application Laid-Open No. Hei 1-111478, workability of inserting the flat circuit body 151 into the direct mounted connector 155 is not good. Namely, the opening is formed on the direct mounted connector 155 into which the flat circuit body 151 is inserted, however, in a small place or an invisible place, the flat circuit body 151 cannot be positioned to the opening and cannot be easily inserted into the opening. If the insertion is failed, the wiring conductor 151*a* provided at the flat circuit body 151 may be damaged.

According to the invention disclosed in Japanese Patent Application Laid-Open No. Hei 9-63718, the flat circuit body 131 is pinched to be held between the temporary maintaining part 138 of the housing 136 and the contacting point 143 of the terminal 140, however, maintaining power is so weak that the flat circuit body 131 may come out of the housing 136 when the flat circuit body 131 is pulled. Moreover, because an interval between the temporary maintaining part 138 and the contacting point 143 is smaller than a thickness of the flat circuit body 131, the flat circuit body 131 is not smoothly inserted into the housing 136 with a small insertion force.

According to the invention disclosed in Japanese Patent Application Laid-Open No. 2000-164295, there is a problem that an operationality in releasing the engagement between the locking hole 124 and the locking projection 107 is not good. Namely, because the vertical wall 115 is formed continuous with the releasing part 110, there is little space so that a fingertip of an operator may not be inserted inside the vertical wall 115 smoothly to depress the releasing part 110. Such a problem will happen when the locking lever 103 and the 110 are small.

Moreover, in a case that the male connector 100 is miniaturized, because of a lack of strength in the vertical wall 115, the vertical wall 115 may be deformed by such as falling. Further, there is another problem that workability in engaging a pair of connectors 100, 120 is not good because it is difficult to catch hold of the male connector 100.

Further, when the locking lever 103 is resiliently deformed, there is a fear of deforming the base 104 plastically because stress concentrates on the base 104 as a root of the locking lever 103. In a cantilever-type locking structure, it is inevitable that the stress concentrates on the base 104 when bending the locking lever 103. Particularly when a projection length of the locking lever 103 is short, because it is difficult to bend such short locking lever 103, it is necessary to bend the locking lever 103 strongly, and the stress concentrating on the base 104 becomes larger, so that it becomes easier to deform the base 104. When the base 104 is slim, it also becomes easy to deform or damage the base 104 because bending stress concentrating on the base 104 becomes larger.

This invention has been accomplished to solve the problems and an object of this invention is to provide a structure for engaging and releasing connectors, whereby damage in the wiring conductor can be prevented when connecting the connectors, the flat circuit body can be easily and reliably inserted into a mating connector, can be accurately positioned, and can be prevented from coming off accidentally, the locking lever and the releasing part can be protected from external interference, the releasing part having a good operationality, the connectors are engaged with each other reliably, and the locking lever is prevented from being deformed at its base side.

SUMMARY OF THE INVENTION

The object of the invention has been achieved by providing a structure for engaging and releasing first and second connectors with each other on a circuit board comprising: the first connector accommodating a terminal to be connected to the circuit board; the second connector on which a flat circuit body is mounted; and a leg portion provided at the second connector for supporting the second connector on the circuit board, whereby a gap is formed between the flat circuit body and the circuit board when the second connector being supported on the circuit board by said leg portion.

According to this structure, because the leg portion is provided on the second connector, the gap is formed between the flat circuit body and the circuit board. Therefore, when the second connector is shifted forward in the engaging direction, the flat circuit body is kept from contact with the circuit board to be prevented from being damaged.

Preferably, in this structure, the leg portion also serves as a projection for positioning the flat circuit body, and a locking hole for engaging with the projection is formed on the flat circuit body.

According to this structure, because the leg portion also serves as a positioning projection, the flat circuit body is positioned by engaging the locking hole of the flat circuit body with the projection, so that a reliability of electrical connections between the wiring conductors formed on the flat circuit body with a small interval and terminals accommodated in the first connector is improved, while the flat circuit body is prevented from coming out.

Preferably, in said structure, a guiding groove for receiving the leg portion is formed at the first connector.

According to this structure, the leg portion of the second connector is inserted into the guiding groove of the first connector. Then, while being positioned in a width direction perpendicular to the engaging direction of the connectors, the second connector approaches an engaging space of the first connector.

Preferably, in this structure, a guiding part for receiving the second connector in a sliding manner is formed at an end of an opening of the first connector, an engaging part for being inserted into the opening is formed at the second connector, and an inclined part for sliding along the guiding part is formed at an end of the engaging part.

According to this structure, because the guiding part is formed at the first connector and the inclined part is formed at the second connector, by facing the second connector to the first connector and pushing the second connector into the first connector, the inclined part shifts slidably on the guiding part to engage the connectors.

Preferably, in this structure, the guiding part and the inclined part respectively have a surface inclining in the same direction.

According to this structure, when pushing the second connector into the first connector, the inclined part runs aground to the guiding part and is guided in a sloping direction of the guiding part, so that the engaging part of the second connector is accurately inserted into the opening of the first connector.

Preferably, in this structure, an adhesive surface is formed on one surface of either the second connector or a cover of the flat circuit body, and a mating surface to be adhered is formed on the other surface for joining the flat circuit body and the second connector with each other.

According to this structure, because the flat circuit body is attached to the connector without folding, the flat circuit body is prevented from swelling outside, so that the connector may be miniaturized. Moreover, because a maintaining force of the flat circuit body is increased with the adhesive force, even when an accidental force pulls the flat circuit body, the flat circuit body is prevented from coming off.

Preferably, in this structure, the second connector includes a locking lever for maintaining a state of engagement of the connectors, and a releasing part for releasing the engagement thereof, wherein said locking lever and a vertical wall for protecting the releasing part from external interference are provided on a wall of the second connector.

According to this structure, the state of engagement of the connectors is maintained by the locking lever, and is released by depressing the releasing part. Further, because the vertical wall for protecting the releasing part from external interference is formed at the second connector, the vertical wall prevents external force from acting the locking lever and the releasing part, so that the engagement between the locking lever and the engaging part is prevented from accidentally being released.

Preferably, in this structure, the vertical walls are provided for surrounding the locking lever and the releasing part.

According to this structure, because the vertical walls are provided for surrounding the locking lever and the releasing part, the locking lever and the releasing part are protected from the external force coming from outside the releasing part, so that the state of engagement between the connectors is maintained.

Preferably, in the structure, the vertical walls facing each other standing from both sides of the releasing part are formed at positions spaced from the releasing part for allowing a finger to be inserted into a working space inside the vertical wall.

According to this structure, because an inner space as the working space surrounded by the vertical walls becomes large, the space for assigning a fingertip to the releasing part is secured, so that even in a small locking mechanism, the releasing part can be reliably depressed.

Preferably, in this structure, a height of the vertical wall is equivalent at least to that of the releasing part.

According to this structure, the locking lever and the releasing part is protected from external interference from above.

Preferably, in this structure, a concave of a notch shape through which the finger escapes is provided on the vertical walls.

According to this structure, because the concave through which the finger escapes is provided on the vertical walls, it becomes easy to assign a fingertip to the releasing part. By putting stress on the fingertip from the state of assigning the fingertip to the releasing part, the releasing part is depressed to release the engagement between the engaging part and the locking lever.

Preferably, in this structure, a pushing wall for pushing the second connector in the engaging direction is provided at a back side of the second connector. By pushing the pushing wall in the engaging direction, the second connector is inserted into the first connector to be engaged with each other.

According to this structure, when pushing the pushing wall in the engaging direction of the connectors, the connectors can be engaged easily and reliably even if the connectors are small.

Preferably, in this structure, the pushing wall is extended to and continued to side walls of the both sides of the second connector.

According to this structure, an area of the pushing wall for assigning a finger becomes larger, so that it becomes easy to push the second connector into the first connector.

Also preferably, the vertical walls facing each other at both sides of the releasing part are connected together by a connecting part.

According to this structure, the connecting part prevents collapse of the vertical walls and the releasing part from external interference from above.

Also preferably, an opening space is provided at the back side of the releasing part without the pushing wall, and a back wall of a connector housing serves as a pushing wall.

According to this structure, by opening the back side of the releasing part, a backside operation of the releasing part is allowed, and the operationality of releasing the engagement is improved.

DESCRIPTION OF THE PREFERRED EMBODIMENT

One embodiment of the structure of connecting shielded connectors according to this invention will now be described below with reference to FIGS. 1 to 5.

Figure 1:
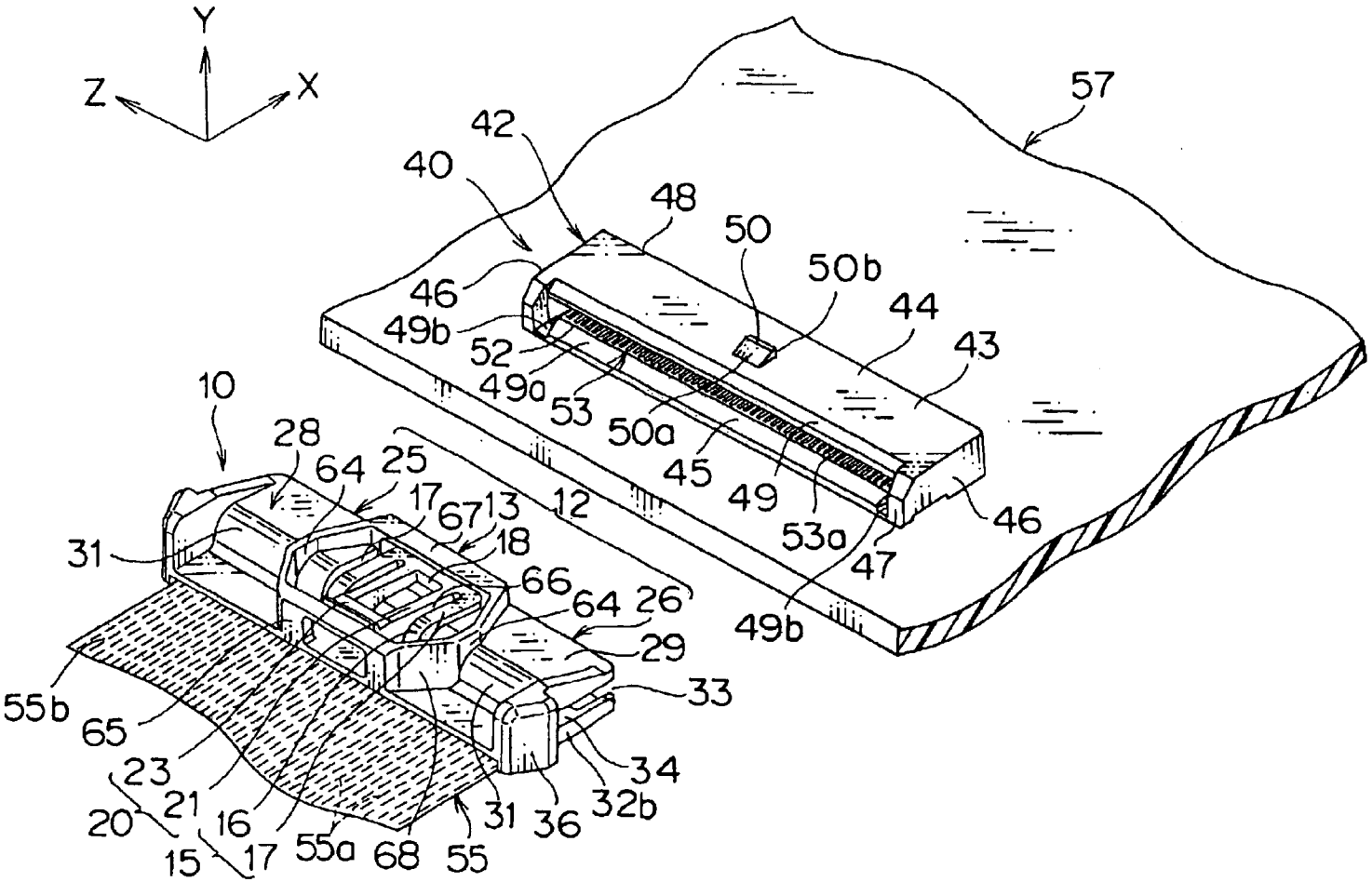
FIG. 1 is a perspective view of a male connector and a female connector facing each other, showing a first embodiment of a structure for engaging and releasing connectors according to this invention.

FIG. 1 shows a male connector (the second connector) 10 to which a flexible flat cable (FFC) 55 as the flat circuit body is attached, and a female connector (the first connector) 40 directly mounted on a printed circuit board (PCB) 57 as the circuit board.

The FFC 55 is a covered electric wire cable for transmitting a control signal and the like between apparatuses mounted on a vehicle, being composed of a plurality of wire conductors 55*a* arranged in parallel. A covering part 55*b* for covering the wire conductor 55*a* is an insulating sheet made of synthetic resin composed of polyvinyl chloride resin, polyethylene resin, and the like. A number of wire conductors corresponds to a number of terminals 53 accommodated in a female connector 40.

Additionally, a flexible printed circuit (FPC, not shown) can also be used as the flat circuit body. A PCB 57 is a circuit board on which the wire conductors (not shown) are printed. In addition, the PCB 57 can also be composed of bus-bars (not shown) as wire conductors, composed of narrow wire conductors formed on an insulating base by insert molding, adhesion, and the like (not shown), or composed of conductive resin (not shown) as wire conductors.

The flat circuit body such as the FFC 55 is attached to a male connector housing 12 of the male connector 10. The terminal 53 directly mounted on the circuit board such as the PCB 57 is accommodated in a female connector housing 42 of the female connector 40.

Figure 2:
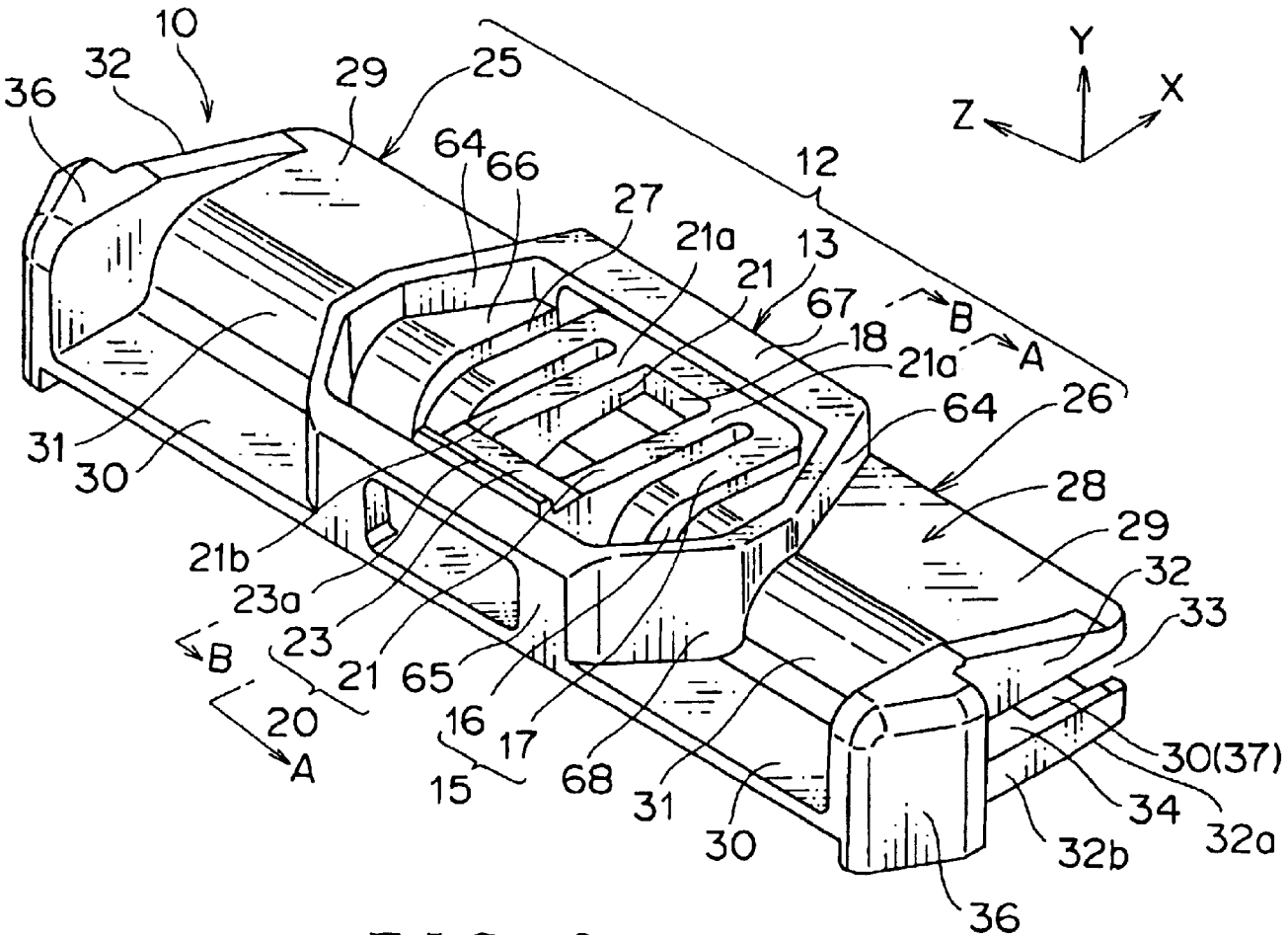
FIG. 2 is a perspective view showing the male connector of FIG. 1.

The male connector 10 includes the FFC 55 and the male connector housing 12. As shown in FIG. 2, the female connector housing 12 is partially made of insulating synthetic resin, and molded by injection molding. This male connector housing 12 is composed of three areas arranged in a line in a longitudinal direction Z. A first area 13 having a locking lever 15 and a releasing lever 20 is formed in a middle of the tree. In two sides of the first area, a second area 25 and third area 26 are formed respectively. These second and third areas 25, 26 are mirror images of each other.

Here, as a matter of convenience for describing this embodiment, we define a back and forth direction (engaging direction of the connectors) X, an up and down direction Y, and a left and right direction (the longitudinal direction) Z as follows (FIG. 1). The back and forth direction X is defined as a direction of engaging the mating connectors 10, 40. The forth side is defined as each side facing the mating connectors 10, 40. The back side is defined as a side opposite to the forth side. The up and down direction is defined as a thickness direction of the FFC 55 or the PCB 57. The up side is defined as a side equipped with the releasing lever (releasing part) 20 and the locking lever 15. The down side is defined as a side opposite to the top side, being equipped with the FFC 55. The left and light direction is defined as a width direction of the male connector 10 and the female connector 40. The left and right sides are not defined, because they are symmetrical.

As shown in FIG. 2, the first, second and third areas 13, 25,26 of the male connector housing 12 are partitioned by partition walls 27 (only one side is shown). The second and third areas 25, 26 have a slot 33 penetrating in the longitudinal direction Z, and the slot 33 opens in the back and forth direction X. A back of the slot 33 is an engaging space 34 for engaging with the female connector 40 (FIG. 1).

Outer walls 28 of the second and third areas 25, 26 are composed of an upper wall 29, a lower wall (base wall) 30, opposite to the upper wall 29, a back wall 31 continued to the upper and lower walls 29, 30, and two side walls 32, 32. A front wall has an opening.

A stopper 36 for positioning the pair of connectors 10, 40 (FIG. 1) in the back and forth direction X, and a leg portion 32*b* for supporting the male connector 10 on the PCB 57 are formed on each side wall 32. The stopper 36 is formed protruding outside the side wall 32 in the left and right direction Z.

The leg portion 32*b* is an extended part extended downward from two side walls 32, 32, and protruding lower than the lower wall 30. Because a length of the leg portion 32*b* is longer than a thickness of the FFC 55, when the male connector 10 is mounted on the PCB 57 (FIG. 1), the FFC 55 is arranged between the PCB 57 and the lower wall 30, while a gap is created between the FFC 55 and the PCB 57.

Therefore, when the male connector 10 is slid in the back and forth direction X on the PCB 57 for engaging the pair of connectors 10, 40, the FFC 55 is kept from contact with the PCB 57 to be prevented from scratching and the like. Thus, connection reliability of the connectors is increased.

An inclined part 32*a* is formed at an end of the leg portion 32*b* in the back and forth direction X. This inclined part 32*a* goes up gradually as it advances in the back and forth direction X, being formed in parallel with an inclined part 37*a* of an engaging part 37 (FIG. 5).

When engaging the pair of connectors 10, 40, each leg portion 32*b* approaches each guiding groove 49*b* formed at each of right and left sides of an opening 49 of the female connector 40 (FIG. 1). Then the leg portion 32*b* approaches the back of an engaging space 52 as being guided by a wall of the guiding groove 49*b*.

Figure 5:
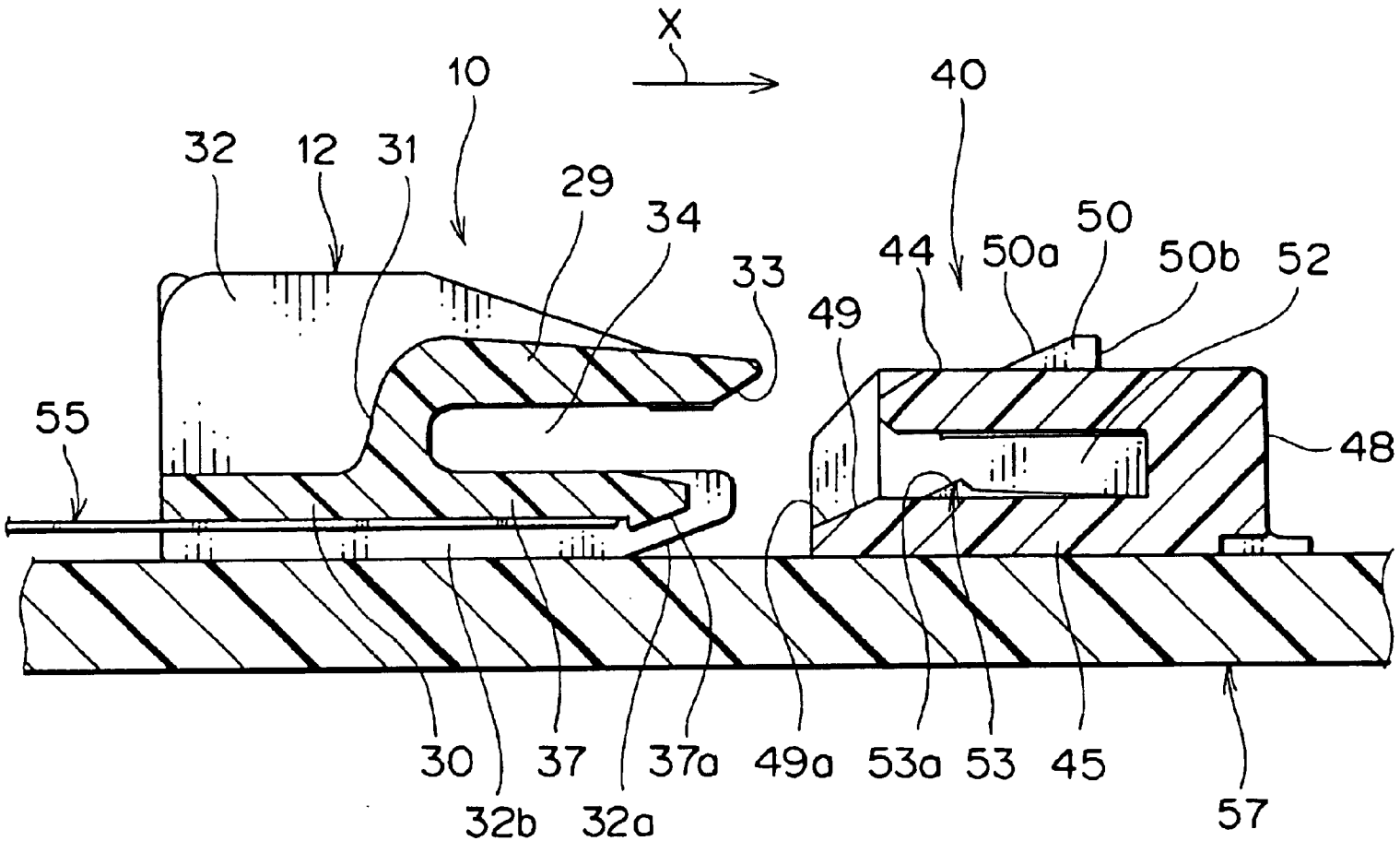
FIG. 5 is a cross-sectional view showing a state of the male and female connectors facing each other before engaging of FIG. 1.

As shown in FIG. 5, the engaging port 37 for being inserted into the opening 49 of the female connector 40 is formed on the lower wall 30 of the male connector 10. The inclined part 37*a* is formed at an end of the engaging part 37. The engaging part 37 runs aground to a guiding part 49*a* formed at an end of the opening 49 so that the connectors 10, 40 can be smoothly engaged with each other.

As well as the inclined part 32*a* formed at the leg portion 32*b*, the inclined part 37*a* goes up gradually as it advances in the back and forth direction X, being formed throughout a width of the engaging part 37. The inclined part 37*a* and the inclined part 32*a* are arranged back and forth, in parallel.

Because the inclined part 37*a* is arranged in a back side of the inclined part 32*a*, when engaging the pair of the connectors 10, 40, at first, the inclined part 32*a* approaches the guiding groove 49*b* (FIG. 1) of the female connector 40, subsequently, the inclined part 37*a* abuts on the guiding part 49*a*. Therefore, when engaging the connectors, the pair of connectors 10, 40 are positioned in the longitudinal direction by the inclined part 32*a* and the guiding groove 49*b*, and positioned in the up and down direction by the inclined part 37*a* and the guiding part 49*a* so as to be engaged with each other accurately.

Further, these directions of the connectors are not limited to this embodiment. For example, the top and bottom sides of one or both of the connectors may be used upside down.

As shown in FIG. 2, vertical walls 64, 64 are formed facing each other standing from both sides of a releasing lever 20. The vertical walls 64, 64 work as protection walls for protecting the releasing lever 20 and the like against the external interference, and are formed in a curved shape surrounding the releasing lever 20. A height of the vertical wall 64 is formed substantially equal to or larger than a height of the releasing lever 20. Therefore, the vertical wall 64 can even protect the locking lever 15 and the releasing lever 20 against the external interference from above.

The vertical walls 64 are standing from the upper wall 29 and the lower wall 30 of the second and third areas 25, 26, and disposed at positions spaced from the releasing lever 20 so that a finger can be inserted into a working space 66. Therefore, an inner space surrounded by a pair of vertical walls 64, 64 becomes larger, a space for assigning a fingertip to the releasing lever 20 is secured, so that an operationality of the releasing lever 20 of a small connector is particularly improved.

Each vertical wall 64 is continuous with a pushing wall 65 arranged at a back end of each vertical wall 64 and a connecting part 67 arranged at a front end of the vertical wall 64. A pushing wall 65 is standing perpendicular to the back and forth direction X, intersected and continuous with both sides of the vertical wall 64. By forming the pushing wall 65 in this manner, it becomes easy to push the male connector 10 in the back and forth direction X, so that it becomes easier especially for small connectors to be engaged with each other.

The connecting part 67 is positioned opposite to the pushing wall 65, and continued to an upper part of the end of the vertical wall 64. The connecting part 67 serves as a reinforcing member for preventing the vertical wall 64 from collapsing in the left and right direction Z and also serves as a protection member for protecting the locking lever 15 and the releasing lever 20 against the external interference from above. Moreover, the connecting part 67 at the end of the vertical wall 64 is positioned so as not to interfere with a free end 17 of the locking lever 15, so that the operationality of the releasing lever 20 is not worse.

As described above, the component of the first area 13 is different from those of the first and second areas 25, 26. The first area 13 includes the locking lever 15. When the male connector 10 and the female connector 40 are engaged with each other (FIG. 1), a locking part 18 of the locking lever 15 is engaged with a locking projection 50 of the female connector 40 so that the state of engagement of the connectors 10, 40 is maintained.

The locking lever 15 is composed of a pair of leg portions 16, 16 (only one of them is shown) standing from the lower wall 30, and the free end 17 in a U-shape continued to and intersected with the leg portions 16, 16.

The pair of leg portions 16, 16 are standing in parallel mutually at a specified interval from a position close to the back side of the lower wall 30. In this manner, stress acting at a base of the locking lever 15 is divided in two directions and a projecting length of the locking lever 15 becomes long, so that the leg portions 16, 16 are prevented from deformation caused by a concentration of stress.

Figure 3:
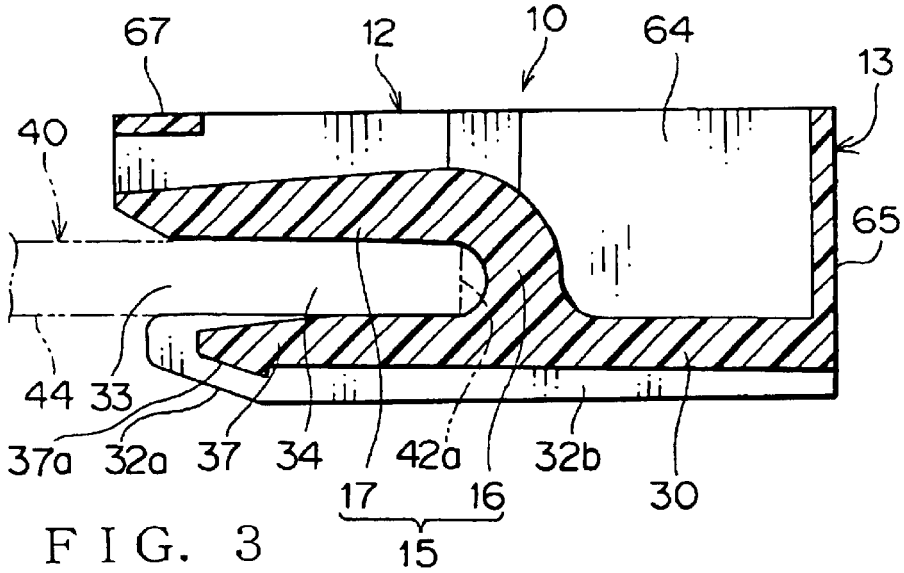
FIG. 3 is a cross-sectional view taken on line A—A of the male connector of FIG. 2.
Figure 10:
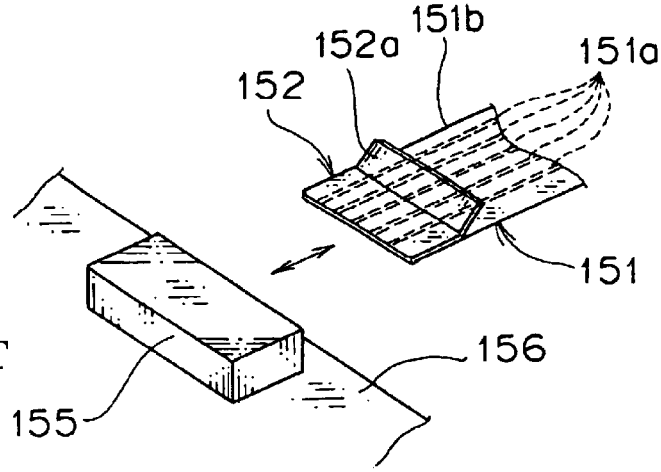
PRIOR ART FIG. 10
FIG. 10 is a perspective view showing one example of conventional structures for engaging and releasing connectors.
Figure 11:
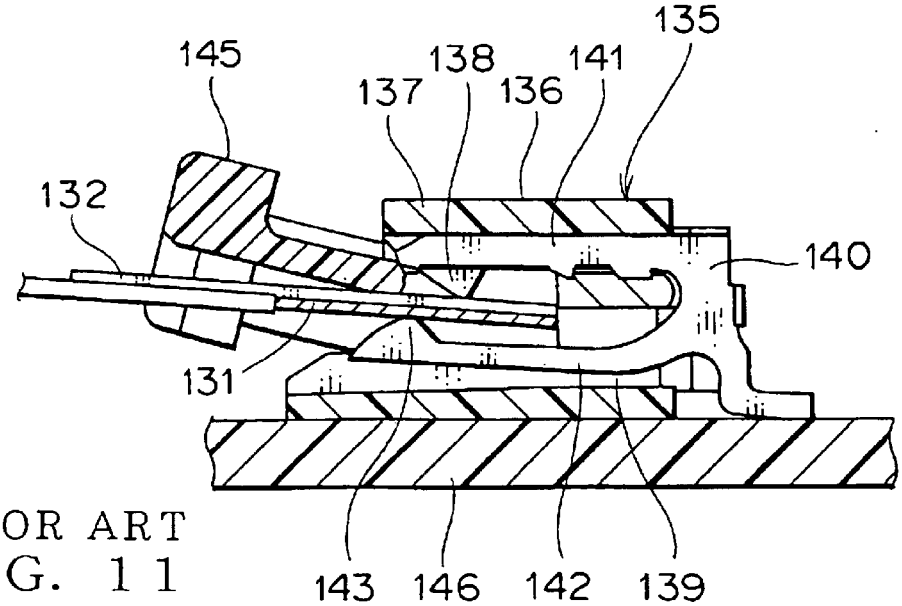
PRIOR ART FIG. 11
FIG. 11 is a cross-sectional view showing another example of the conventional structures for engaging and releasing connectors.

The free end 17 is intersected with and continuous with the leg portions 16, 16, and goes down gently, gradually as it approaches its front side (FIG. 3). The locking part 18 is formed at a U-shaped edge of the free end 17 (FIG. 2).

The releasing lever 20 is arranged inside the pair of leg portions 16, 16, and continuous with the free end 17 of the locking lever 15. The releasing lever 20 is composed of a pair of arm parts 21, 21 and a depressing part 23 intersected with and continued to each of the arm parts 21, 21. Thus, the releasing lever 20 can be miniaturized.

One end of the arm portion 21 is continued to the free end 17 of the locking lever 15, being extended from the free end 17 to the leg portion 16 in a U-turn shape, while the other end of the arm portion 21 is extended backward over the leg portion 16. Because the arm portion 21 is formed with a long span in this manner, using the principle of leverage, the releasing lever 20 can be depressed and the free end 17 can be lifted with a little force to release the engagement.

Moreover, the arm portion 21 has a inclined part going down gradually from a back end 21*b* to a front end 21*a* (FIG. 4) so that a depressing margin is fully secured.

Each back end 21*b* of the pair of arm part 21, 21 is connected by the depressing part 23. Because the depressing part 23 is curved inside the arm portion 21, the releasing lever 20 formed a U-shape. A rib 23*a* is formed projecting upward throughout a width of a back-end edge of the depressing part 23. In this manner, when a finger depresses the depressing part 23, the finger is prevented from slipping so that the operationality of the releasing lever 20 is increased.

Figure 4:
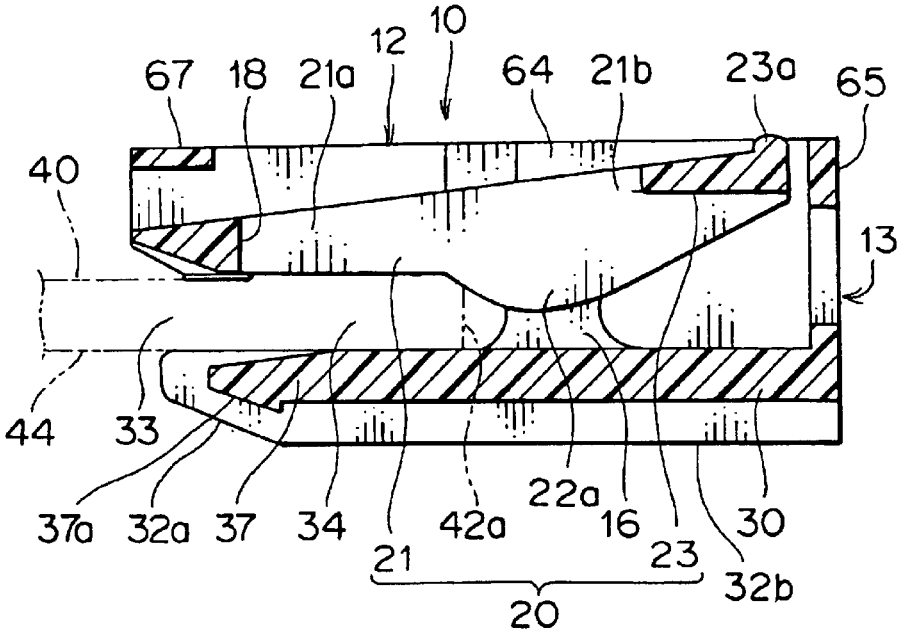
FIG. 4 is a cross-sectional view taken on line B—B of the male connector of FIG. 2.
Figure 12:
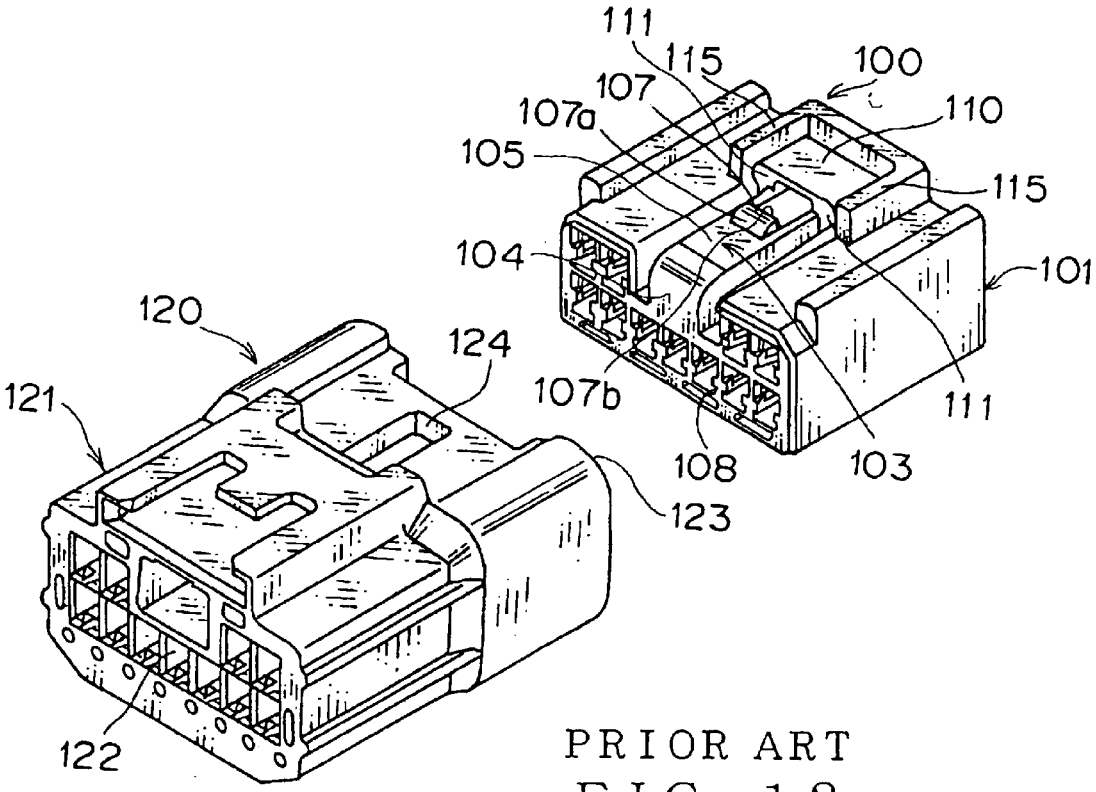
PRIOR ART FIG. 12
FIG. 12 is a perspective view showing another example of the conventional structures for engaging and releasing connectors

As shown in FIG. 4, a projecting part 22*a* for abutting on a front-end part 42*a* of the female connector 40 is provided at a center of an inner surface of the arm portion 21. The projecting part 22*a* is formed projecting downward. Therefore, the projecting part 22*a* serves as a fulcrum of a lever, and by depressing the depressing part 23, the front end 21*a* of the arm portion 21 is lifted. Thus, the releasing lever 20 is operated with a small force so that the engagement may be easily released.

As shown in FIG. 1, the female connector 40 includes the female connector housing 42 having the engaging space 52 and a terminal 53 directly mounted on the PCB 57. An outer wall 43 of the female connector housing 42 is composed of an upper wall 44, a lower wall 45, both side walls 46, 46 continued to left and right ends of the upper wall 44 and the lower wall 45, a front wall 47 on which the opening 49 is formed, and a back wall 48 arranged at an opposite side of the front wall 47.

The locking projection 50 for locking with the locking part 18 of the locking lever 15 is formed at a center of the upper wall 44. The locking projection 50 includes an inclined part surface 50*a* to which the locking part 18 runs aground and a locking surface 50*b* continued to the slope surface 50*a*. By engaging the locking projection 50 with the locking part 18 of the locking lever 15, a state of engagement of the connectors 10, 40 is maintained.

The lower wall 30 of the male connector 10 (engaging part 37) is allowed to be inserted into the engaging space 52. The upper wall 29 of the male connector 10 is allowed to overlap with the upper wall 44 of the female connector 40. Namely, the upper wall 44 of the female connector 40 is inserted between the upper wall 29 and the lower wall 30 of the male connector 10, and the lower wall 30 of the male connector 10 is inserted between the upper wall 44 and the lower wall 45, so that the connectors 10, 40 are engaged with each other.

The guiding part 49*a* is formed at an end of the opening 49 of the lower wall 45 of the female connector 40. The guiding part 49*a* is a slope surface to which the slope 37*a* formed at an end of the engaging part 37 of the male connector 10 runs aground. In this manner, the male connector 10 is pushed in the back and forth direction X and slid on the PCB 57 so that the male connector 10 may be accurately engaged with the female connector 40.

The terminal 53 is embedded in the lower wall 45 of the female connector 40. An electric connecting part 53*a* is exposed from an inside of the lower wall 45. The conductor 55*a* of the FFC 55 is connected to the electric connecting part 53*a* so that a control signal may be exchanged between the male connector 10 and the female connector 40.

FIGS. 6 to 9 show a second to fifth embodiments of the male connector having the structure for engaging and releasing connectors according to this invention. Same component part between the first and the second to fifth embodiments is attached to the same reference numeral for explaining.

Figure 6:
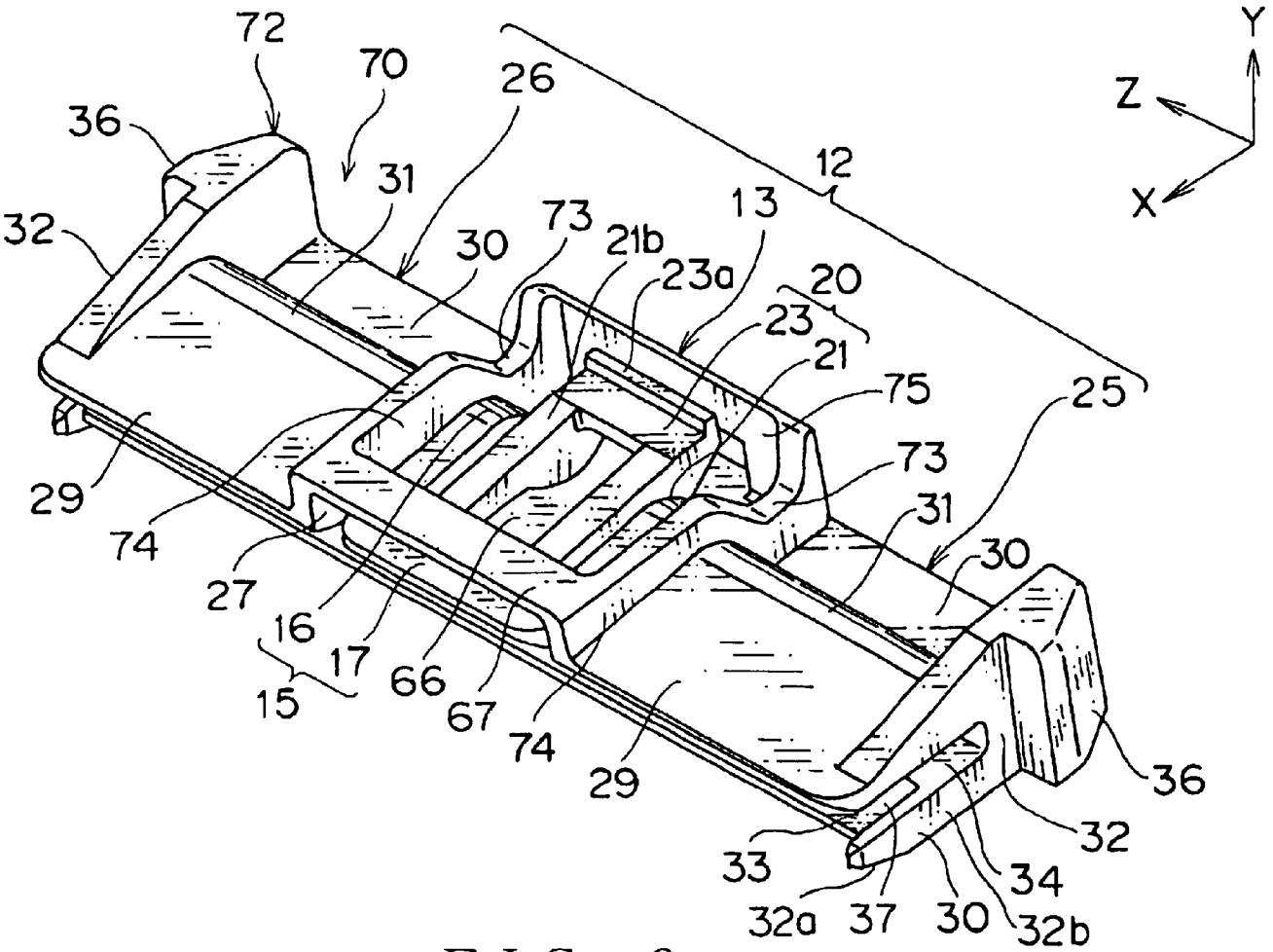
FIG. 6 is a perspective view of a male connector, showing a second embodiment of the structure for engaging and releasing connectors according to this invention.

The second embodiment will be described with reference to FIG. 6. The main difference between the first and the second embodiment is that a concave 73 in a notch shape is formed on vertical walls 74, 74 at both sides of the releasing lever 20 in the second embodiment. A point where the releasing lever 20 is arranged inside the locking lever 15 is common to the first and second embodiments.

Because a vertical wall 74 is not curved outward, the working space 66 becomes smaller than that of the first embodiment, however, the concave 73 is formed at the vertical wall 74 so that the operationality of the releasing lever 20 may not become worse.

Namely, because a pair of the concave 73 is formed facing each other at both sides of the depressing part 23 of the releasing lever 20, by releasing a finger to the concave 73, a fingertip can be assigned to the releasing lever 20. Then, by putting stress on the fingertip from the state of assigning the fingertip to the releasing lever 20, the releasing lever 20 is depressed to release the engagement between the locking projection 50 and the locking lever 15. This structure of this embodiment is particularly effective in a locking structure of a small connector having the releasing lever 20. In addition, the concave 73 of this embodiment may be formed on the vertical wall 64 of the first embodiment.

Figure 7:
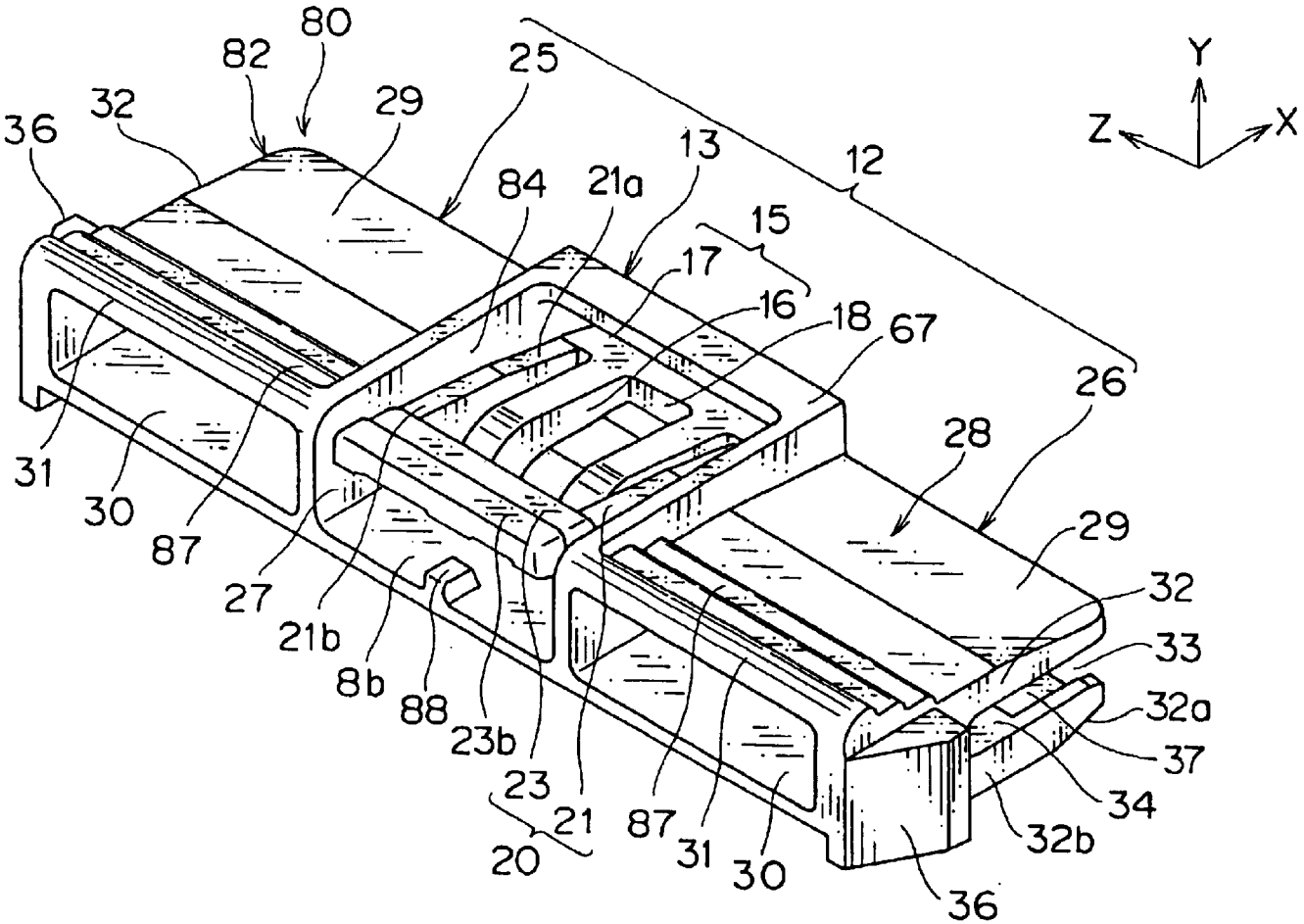
FIG. 7 is a perspective view of a male connector, showing a third embodiment of the structure for engaging and releasing connectors according to this invention.

Next, the third embodiment will be described with reference to FIG. 7. The main differences between the first and the third embodiment are that the releasing lever 20 is positioned at an outside of the pair of leg portions 16, 16 of the locking lever 15, and the pushing wall 65 (FIG. 2) is not provided at the back side of the releasing lever 20 in the third embodiment. Although the pushing wall 65 is not provided, the back wall 31 of the second area 25 and the third area 26 also serves as the pushing wall. Because the releasing lever 20 is disposed outside the pair of leg portions 16, 16, the releasing lever 20 is allowed to be so large as to improve the operationality of the releasing lever 20.

Because the vertical walls 74 is continued to the partition wall 27 integrally as in the case of the second embodiment, the working space 66 is smaller than that of the first embodiment. However, because the back side of the releasing lever 20 is open, the operationality of the releasing lever 20 may not become worse.

Namely, by the back side of the releasing lever 20 being open, an operation of the release lever 20 from the back side is allowed. Even if an operation of the releasing lever 20 from the upper side is allowed, there is an advantage that the operationality of the releasing lever 20 is improved by allowing the operation from the back side.

Because the back wall 31 that also serves as the pushing wall is continued to the upper wall 29, the strength of the back wall 31 is so increased as not to be deformed and damaged at the time when the back wall 31 is pushed by a fingertip. Because a step 87 is formed on the upper wall 29 at the back wall 31 side, the pair of connectors 80, 40 is easily released by assigning the fingertip to the step 87 to pull backward without a slip of the fingertip.

A projection 88 for regulating a deformation of the releasing lever 20 is formed projecting at an upper surface of the lower wall 30. Because the projection 88 is positioned opposite to a substantial center of the depressing part 23, when depressing the depressing part 23, the depressing part 23 is prevented from being depressed toward one of either left or right side disproportionately.

Because of providing the projection 88, when depressing the depressing part 23, the lower surface of the depressing part 23 abuts on a top surface of the projection 88 to prevent an excessive resilient deformation of the releasing lever 20 so that the releasing lever 20 is prevented from being damaged. Because other components are similar to those of the first embodiment, an explanation of the other components is omitted.

Figure 8:
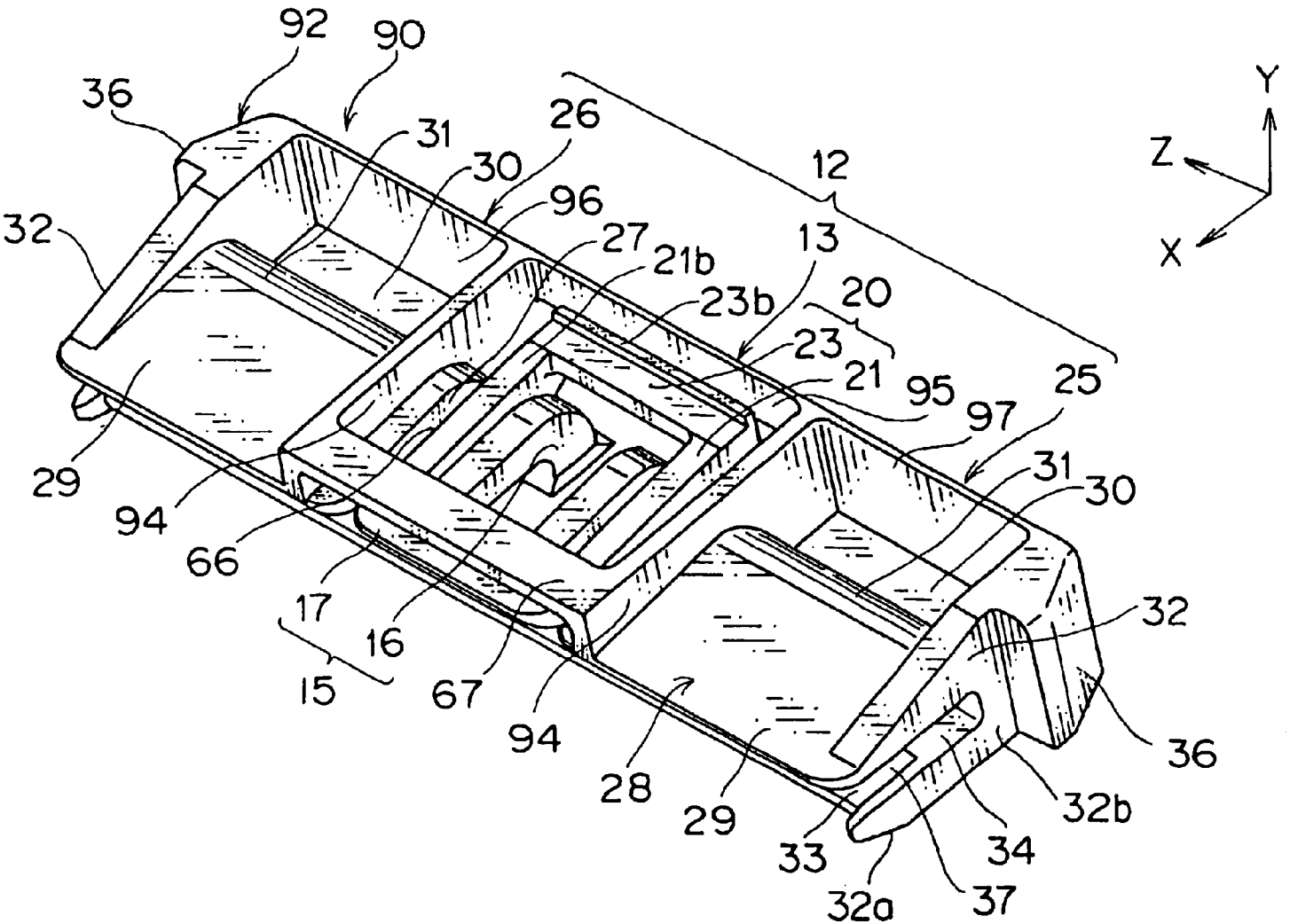
FIG. 8 is a perspective view of a male connector, showing a fourth embodiment of the structure for engaging and releasing connectors according to this invention.

Next, the fourth embodiment will be described with reference to FIG. 8. The main difference between the first and the fourth embodiment is that a pushing wall 95 is extended in the longitudinal direction Z and continued to side walls 32 at both sides of a male connector housing 92 in the fourth embodiment. Namely, the pushing wall 95 is formed throughout a width of the male connector housing 92 in the longitudinal direction Z. The second and the third pushing walls 96, 97 formed at the second and the third areas respectively are standing from the lower wall 30 opposite to the back wall 31.

Because the second and the third pushing walls 96, 97 are formed in this manner, an area of the pushing walls 95, 96, 97 to which the fingertip is assigned to is increased to make the fingertip easier to push the male connector 10 into the mating connector housing. Because other components of this embodiment are similar to those of the first embodiment, an explanation of the other components is omitted. In addition, the second and the third pushing walls 96, 97 may be provided on the male connector of the first and the second embodiments.

Figure 9:
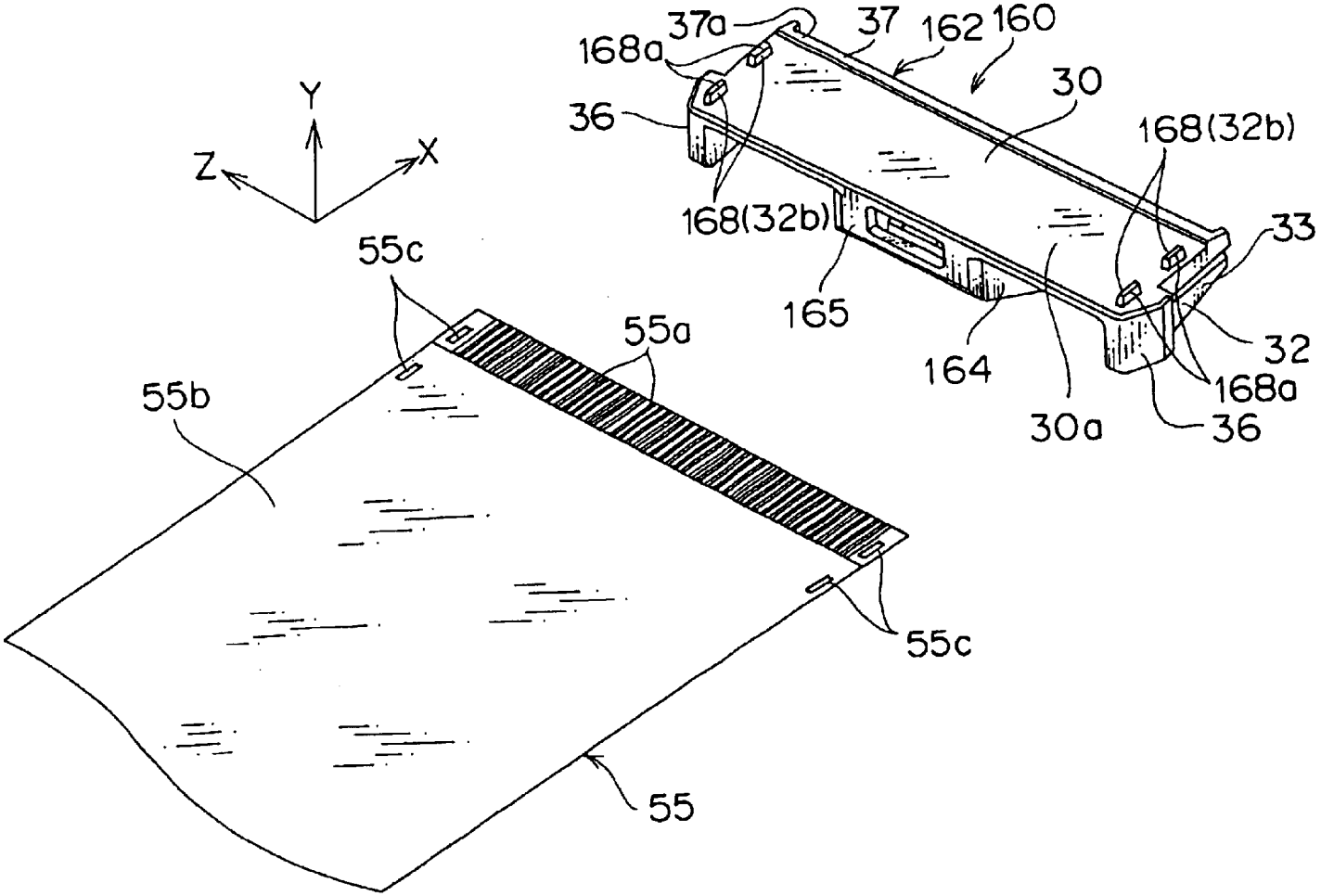
FIG. 9 is a perspective view of a male connector, showing a fifth embodiment of the structure for engaging and releasing connectors according to this invention.

Next, the fifth embodiment will be described with reference to FIG. 9. The main difference between the first and this embodiment is that a positioning projection 168 (leg portion 32*b*) is provided at a back surface 30*a* of the lower wall 30 of a male connector 160 in the fifth embodiment.

Because the positioning projection 168 also serves as the leg portion 32*b*, a projection height of the positioning projection 168 is formed longer than a thick of the FFC 55. Namely, when attaching the FFC 55 to the lower wall 30, a tip 168*a* of the positioning projection 168 is protruding from the FFC 55. Therefore, when the male connector 160 is mounted on the PCB 57, the male connector 160 is supported by four points of the tips 168*a* of the positioning projection 168, and the FFC 55 is positioned between the PCB 57 and the lower wall 30, so that the FFC 55 does not abut on the PCB 57 to prevent its surface from being damaged.

A locking hole 55*c* of the FFC 55 is engaged with the positioning projection 168, so that the FFC 55 is positioned in the back and forth direction X, and in the left and right direction Z. In this manner, connection reliability between the respective conductors 55*a* arranged with a small pitch on the FFC 55 and the respective terminals 53 (FIG. 1) is maintained.

The number of the positioning projections 168 is optional, and in this embodiment, two positioning projections 168 are provided at right and left sides each. In addition, one, three, or more positioning projection 168 may be formed at right and left sides each.

Moreover, the back surface 30*a* of the lowerwall 30 is formed in a flat surface except for the positioning projection 168 and serves as an adhesive surface to the FFC 55. A bonded surface of the FFC 55 to be bonded to this adhesive surface is the covering part 55*b* where the conductors 55*a* are not exposed. The bonded surface is easily bonded by applying an adhesive to the surface and lapping the FFC 55 over the surface. In addition, it is also acceptable that the FFC 55 has an adhesive surface and the back surface 30*a* of the lower wall 30 is a bonded surface.

A guiding groove, which allows the approach of the positioning projection 168, is formed at a female connector (not shown) to be connected to the male connector 160 of this embodiment. Said guiding groove is equivalent to the guiding groove 49*b* in the first to fourth embodiments. Therefore, the male connector 160 approaches the engaging space while being guided by the guiding groove. Because other components are similar to those of the first embodiment, an explanation of the other components is omitted.

Although this invention has been fully described by way of examples with reference to the accompanying drawings, it is to be noted that various changes and modifications can be made in a scope of this invention.

What is claimed is:

1. A structure for engaging and releasing first and second connectors with each other on a circuit board comprising:

the first connector accommodating a terminal to be connected to the circuit board;

the second connector having a underside on which a flat flexable circuit body is fixedly mounted; and a leg portion provided at the second connector for supporting the second connector on the circuit board, whereby a gap is formed between the flat circuit body and the circuit board when the second connector being supported on the circuit board by said leg portion.

2. The structure as claimed in claim 1, wherein said leg portion also serves as a projection for positioning the flat circuit body, and a locking hole for engaging with the projection is formed on the flat circuit body.

3. The structure as claimed in claim 1, wherein a guiding groove for receiving the leg portion is formed at the first connector.

4. The structure as claimed in claim 1, wherein a guiding part for receiving the second connector in a sliding manner is formed at an end of an opening of the first connector, an engaging part for being inserted into the opening is formed at the second connector, and an inclined part for sliding the guiding part there along is formed at en end of the engaging part.

5. The structure as claimed in claim 4, wherein the guiding part and the inclined part respectively have a surface inclining in the same direction.

6. The structure as claimed in claim 1, wherein an adhesive surface is formed on one surface of either the second connector or a cover of the flat circuit body, and a mating surface to be adhered is formed on the other surface for joining the flat circuit body and the second connector with each other.

7. The structure as claimed in claim 1, wherein the second connector includes a locking lever for maintaining a state of engagement of the connectors, and a releasing part for releasing the engagement thereof, wherein said locking lever and a vertical wall for protecting the releasing part from external interference are provided on a wall of the second connector.

8. The structure as claimed in claim 7, wherein the vertical walls are provided for surrounding the locking lever and the releasing part.

9. The structure as claimed in claim 7, wherein the vertical walls facing each other standing from both sides of the releasing part are formed at positions spaced from the releasing part for allowing a finger to be inserted into a working space inside the vertical wall.

10. The structure as claimed in claim 7, wherein a height of the vertical wall is equivalent at least to that of the releasing part.

11. The structure as claimed in claim 7, wherein a concave of a notch shape through which the finger escapes is provided on the vertical walls.

12. The structure as claimed in claim 7, wherein a pushing wall for pushing the second connector in the engaging direction is provided at a back side of the second connector, wherein by pushing the pushing wall in the engaging direction, the second connector is inserted into the first connector to be engaged with each other.

13. The structure as claimed in claim 12, wherein the pushing wall is extended to and continued to side walls of the both sides of the second connector.

* * * * *